United States Patent [19]

Vaughn

[11] Patent Number: 4,498,238

[45] Date of Patent: Feb. 12, 1985

[54] TRANSPARENT PERSPECTIVE TRACING BOARD

[75] Inventor: James N. Vaughn, Georgetown, Ind.

[73] Assignee: Richard L. Caslin, Louisville, Ky.

[21] Appl. No.: 429,949

[22] Filed: Sep. 30, 1982

[51] Int. Cl.[3] ..... B44D 2/00

[52] U.S. Cl. ..... 33/1 K; 33/262; 434/90; 434/91

[58] Field of Search ..... 33/1 B, 1 K, 262, 276, 33/277, 299; 434/88, 90, 91; 248/441 A, 444

[56] References Cited

U.S. PATENT DOCUMENTS

| | | | |
|---|---|---|---|
| 464,359 | 12/1891 | Hagan | 434/90 |
| 761,033 | 5/1904 | Cross | 434/90 |
| 2,487,690 | 11/1949 | Black et al. | 434/91 |
| 3,479,741 | 11/1969 | Nicyper | 434/91 |
| 3,834,043 | 9/1974 | Summers | 434/91 |

FOREIGN PATENT DOCUMENTS

| | | | |
|---|---|---|---|
| 857785 | 9/1940 | France | 434/91 |
| 971147 | 1/1951 | France | 434/91 |
| 971148 | 1/1951 | France | 434/91 |

OTHER PUBLICATIONS

C.D.I., "The P-Scope Instruction Manual", 1982, 4 pp.

*Primary Examiner*—Richard R. Stearns
*Attorney, Agent, or Firm*—Richard L. Caslin

[57] ABSTRACT

A transparent perspective hand-held tracing board is shown for use with a sheet of transparent drawing material. This board is formed of a rigid plastic or glass panel. A measured pattern is imprinted on the panel to assist in judging distance and relative angles. A supporting handle is mounted from one side edge of the panel for use by one hand in holding the panel in space so that an object being drawn at a distance may be sighted both through the drawing material and the board, and the angle and distance of the board may be adjusted to fit on the said measured patterns so the object may be traced on the drawing material.

1 Claim, 6 Drawing Figures

TRANSPARENT PERSPECTIVE TRACING BOARD

BACKGROUND OF THE INVENTION

1. Field of the Invention:

This invention relates to the art of drawing boards for artists and draftsmen, and particularly to transparent drawing boards for drawing or tracing perspective views seen through the board of objects or scenes which are at a distance from the board.

2. Description of the Prior Art:

Drawing boards are basically hard, smooth-surfaced boards or tables which are opaque, and drawing paper or a similar medium is fastened to the top surface thereof. Complex perspective views are difficult to draw. One technique that is used is to take a photograph of a remote object or scene, and to trace the photograph onto a drawing paper or other medium.

The Fish U.S. Pat. No. 4,379,364 describes a large, transparent sketching surface that includes a base having nesting folding legs or it is supported over the artist's knees when the artist is in a sitting position. Extending from the base is a chin rest post that has a chin rest supported on the upper end thereof. This transparent sketching surface is not provided with a measured pattern to assist in judging distance and relative angles. The Black et al U.S. Pat. No. 2,487,690 describes a perspective aid device for a grid pattern with right-hand and left-hand vanishing point representations, but the base or board element of this device is opaque for supporting a first lower element with a left-hand vanishing point and a translucent or transparent sheet 21 having a right-hand vanishing point representation.

The Nicyper U.S. Pat. No. 3,479,741 describes a set of underlay drafting panels having a measured pattern, but these panels are adapted to be used on a standard drafting board and are not transparent, as in the present invention.

The Summers U.S. Pat. No. 3,834,043 describes an art instructing apparatus that is larger than human size to allow art students to compose three-dimensional perspective scenes for reproduction in two-dimensional forms. There is a large transparent grid that is larger than human size. An elastic cord extends from each side of the transparent panel to the top of the foreground figure model behind the panel, and a second elastic cord extends from each side spring clip to the bottom of the foreground figure model so as to generate left-hand and right-hand vanishing points. These two side spring clips are mounted on vertical posts and may be vertically adjusted; however, this patent does not teach applying a transparent drawing material over the transparent drawing board for sketching a distant object behind the transparent board unto the transparent drawing material.

OBJECTS OF THE PRESENT INVENTION

The principal object of the present invention is to provide a transparent perspective drawing board adapted for use with a sheet of transparent drawing material so that a user may sight a remote object or scene through the hand-held tracing board and trace the object or scene onto the drawing material in a quick and accurate reproduction or diagram of the object or scene.

A further object of the present invention is to provide a transparent drawing board of the class described with a measured pattern representing both distance and relative angles for assistance in arranging the object or scene with respect to the pattern prior to tracing a drawing on the tracing material.

A further object of the present invention is to provide a transparent tracing board of the class described with a supporting handle at one edge thereof for holding the board steady while the drawing is applied to the tracing material.

A further object of the present invention is to provide a transparent tracing board of the class described with a graph paper grid superimposed over perspective projections having a true height line with both a left-hand and a right-hand vanishing point.

SUMMARY OF THE INVENTION

The present invention provides a transparent perspective drawing board adapted for use with a sheet of transparent drawing material. A measured pattern is imprinted on the hand-held tracing board to assist in judging distance and relative angles. A supporting handle is formed at one side edge of the transparent board for use in holding the broad in space, generally fixed at a predetermined angle with respect to a remote object or scene that is to be drawn or traced. The object or scene is sighted through both the transparent board and the transparent drawing material, and markings are applied to the drawing material to form a diagram or representation of the respective object or scene.

BRIEF DESCRIPTION OF THE DRAWINGS

This invention will be better understood from the following description taken in conjunction with the accompanying drawings, and its scope will be pointed out in the appended claims.

DESCRIPTION OF THE PREFERRED EMBODIMENTS

Figure 1:
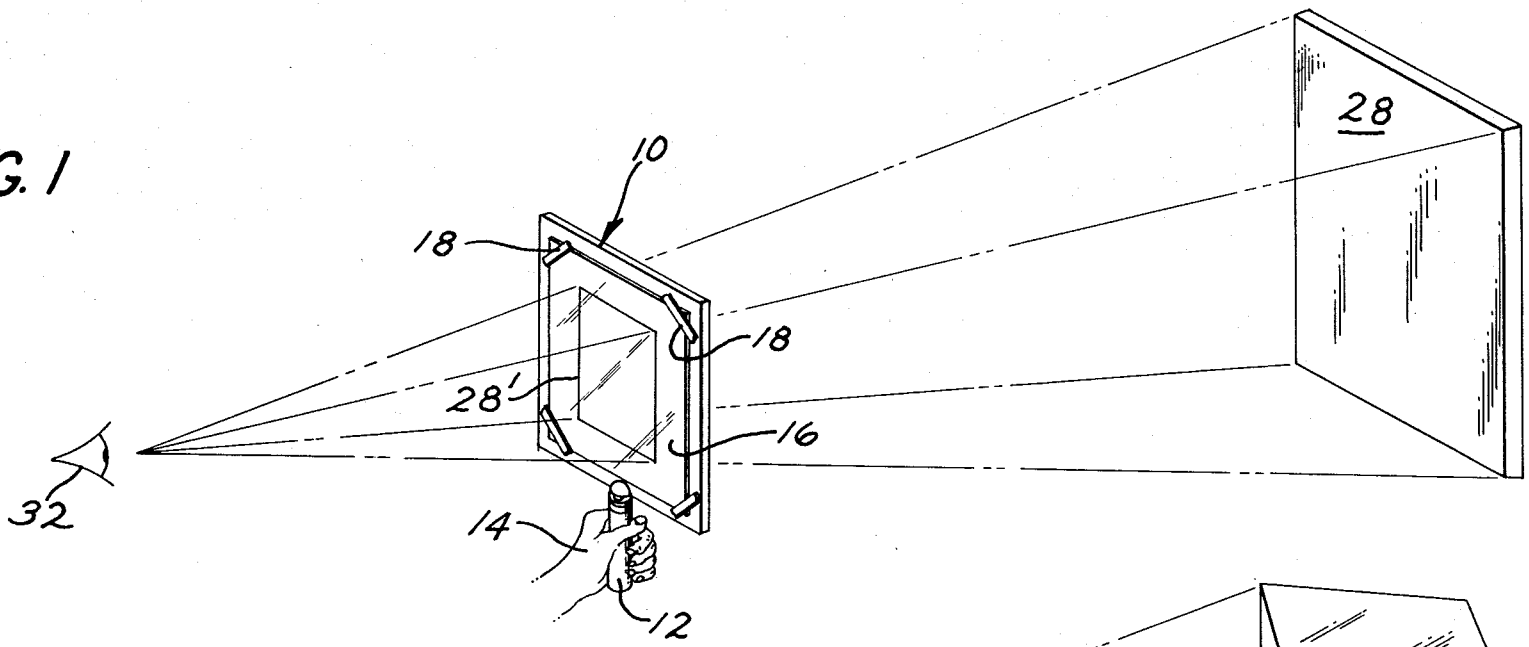
FIG. 1 is a front perspective view of a transparent perspective hand-held tracing board having a sheet of transparent drawing material fastened to the front surface thereof, and a handle attached to the lower edge of the board and held in the grasp of one hand of the user, there being a remote planar object at the right side in the distance, while the user is depicted by a showing of the human eye at the far left of the Figure.

Turning now to a consideration of the drawings, and in particular to FIG. 1, there is a showing of a transparent perspective tracing board 10 embodying the present invention. This board is formed as a rigid panel of transparent materials, such as plastic or glass. A separate supporting handle 12 is shown formed on one side of the panel; namely, the bottom side, and a user's hand 14 is shown grasping the handle 12 and holding the drawing board 10 in space at a predetermined angle. A supporting handle is important in the practice of the present invention in order to provide a hand-hold with mechanical advantage to assist in holding the transparent panel 10 for long periods of time while tracing. Attached to the front surface of the tracing board 10 is a sheet of transparent drawing material 16, which is attached at its corners to the board by means of short strips of masking tape 18. Of course, other means may be employed for holding the drawing material 16 to the board 10, such as, by use of a spring clamp (not shown).

Figure 3:
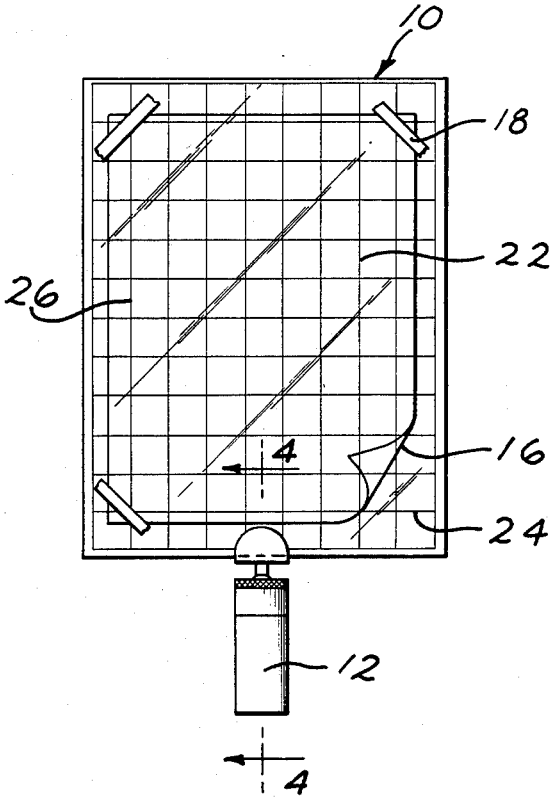
FIG. 3 is a front elevational view, on an enlarged scale, of the transparent perspective tracing board of FIGS. 1 and 2 showing a measured pattern imprinted on the transparent board to assist in judging distance and relative angles.

Turning to a consideration of the front elevational view of the tracing board of FIG. 3, the identical elements are shown with the same reference numerals, as described above. Imprinted on the front or rear surface of the transparent tracing board 10 is a measured pattern of a graph-like grid of uniformly-spaced horizontal lines 24 and perpendicular lines 26. These lines may be printed with a permanent ink, or they may be scribed into the surface of the board to form a faint suggestion of a line without being too prominent. The purpose of this measured pattern on the tracing board is to assist the user in judging distance and relative angles, it being understood that this grid is a scaled-down version of a distant object 28 that is illustrated in FIG. 1 as being viewed by the user 32 peering through both the transparent tracing material 16 and the transparent drawing board 10. Thus, the user will carefully position the drawing board 10 at a proper angle so that the image of the distant object 28 will appear on the sheet of drawing material 16. The user may use a drawing instrument (not shown) to trace the image of the object 28 to produce the image or tracing 28', as seen in FIG. 1. The distant object 28 is a planar object, and thus the tracing is a simple rectangle 28'.

Figure 2:
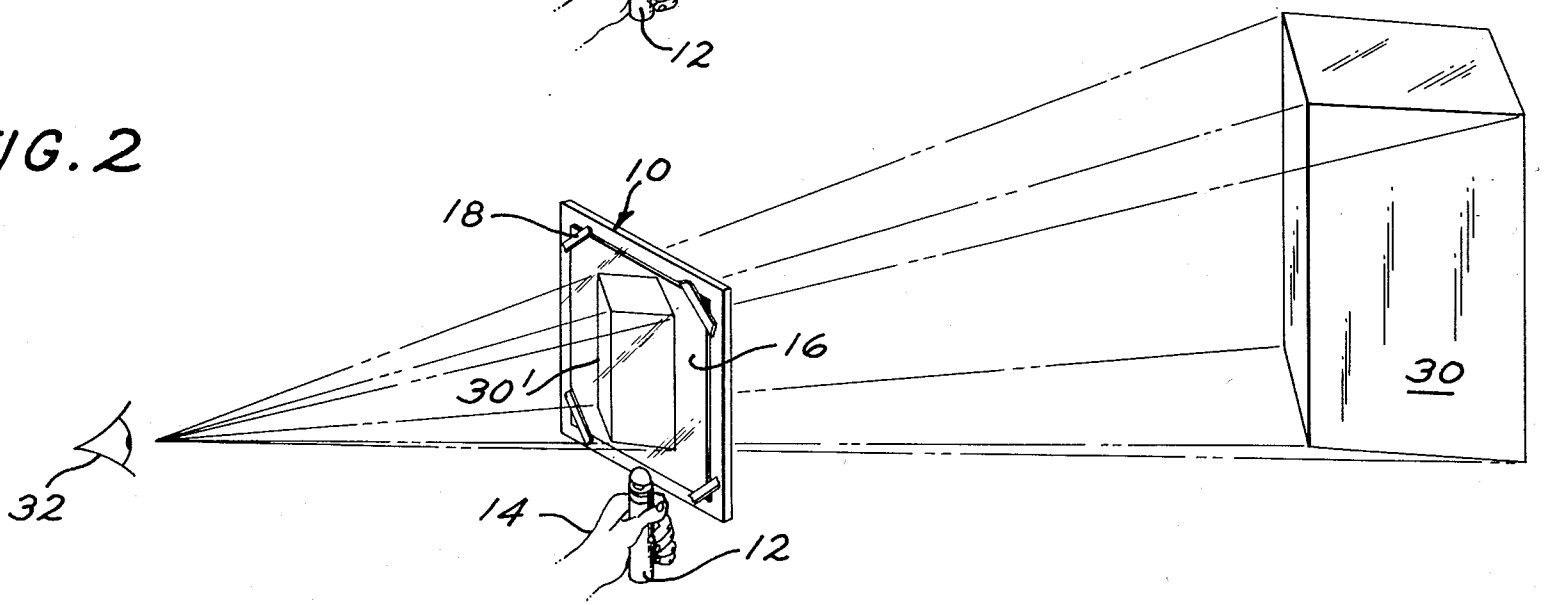
FIG. 2 is a front perspective view, similar to that of FIG. 1, of a transparent perspective tracing board, where the remote object at the right side of the Figure at a distance from the drawing board is a vertical elongated block rather than a planar object.

Looking at FIG. 2, the distant object 30 is a square elongated block that is set at a perspective angle with respect to the tracing board 10, such that the tracing 30' illustrates the three-dimensional nature of the object 30; namely, the height, the width and the depth. While the measured pattern 22 of FIG. 3 is not illustrated in FIGS. 1 and 2, it should be understood that the measured pattern is an important part of the present invention, in that it helps the user line up the board with respect to the distant object in order to get the proper perspective angles.

Figure 6:
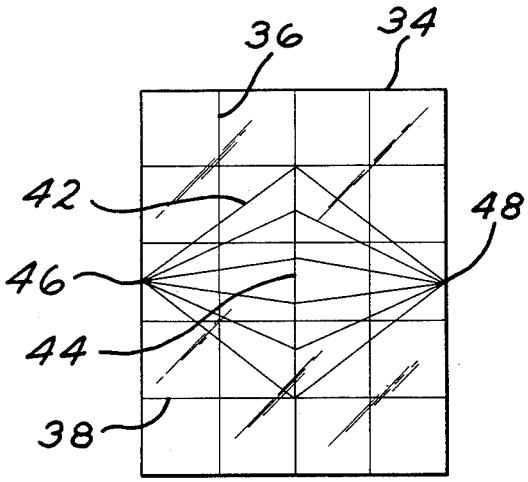
FIG. 6 is a front elevational view of a sheet of transparent drawing material, such as plastic, Mylar, tracing paper or the like, having printed thereon, very lightly, both a graph-like grid pattern having superimposed thereon a series of perspective projections having at the center a true height line, as well as both a left-hand and a right-hand vanishing point.

It will be understood by those skilled in this art that this measured pattern 22 may either be in the drawing board 10 or in the sheet of tracing material 16. FIG. 6 of the drawing shows a second modification where the sheet of transparent drawing material 34 is usable in place of the sheet 16. This transparent sheet 34 has imprinted thereon a measured pattern 36 of uniformly-spaced horizontal lines 38, as well as perpendicular lines 40. In addition, this measured pattern 36 includes perspective projections 42 having a true vertical height line 44, with both a left-hand vanishing point 46 and a right-hand vanishing point 48. It will be understood by those skilled in this art that these perspective projections 42 of FIG. 6 could just as well have been imprinted directly on the transparent drawing board 10 of FIGS. 1–3.

Figure 4:
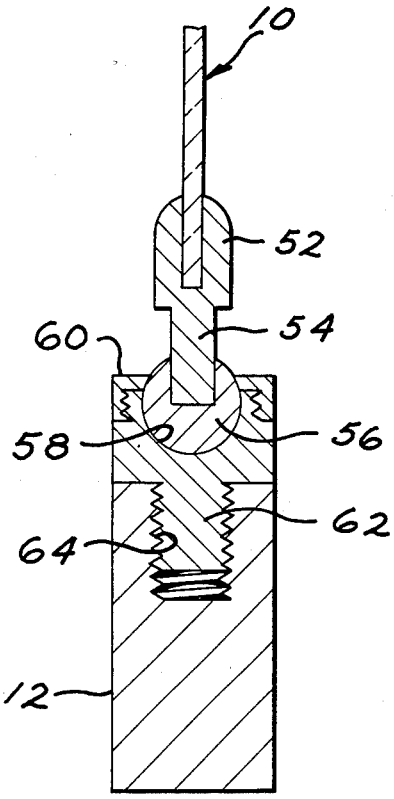
FIG. 4 is a fragmentary, vertical cross-sectional view of the handle and the lower portion of the transparent tracing board, taken on the line 4—4 of FIG. 3, showing a universal pivot between the handle and the drawing board for providing angular adjustability between these two parts.

FIG. 4 is a cross-sectional, elevational view of the lower end of the transparent tracing board 10 of FIG. 3 taken on the line 4—4 of FIG. 3. A rigid clamp member 52 is formed integral with the lower edge of the tracing board 10, as with an adhesive material or the like. This clamp member has a vertical strut portion 54 which terminates in a ball 56 that mates in a spherical socket 58 and is held in place by the threaded cap 60. The lower portion of this spherical socket is provided with a threaded post 62 that threads into a threaded hole 64 in the top end of the handle 12. The main purpose of the ball 56 and socket 58 connection between the tracing board 10 and the handle 12 is to give the tracing board angular adjustability so as to properly position the image of the distant object 28 or 30 on the sheet of drawing material 16 or 34.

Figure 5:
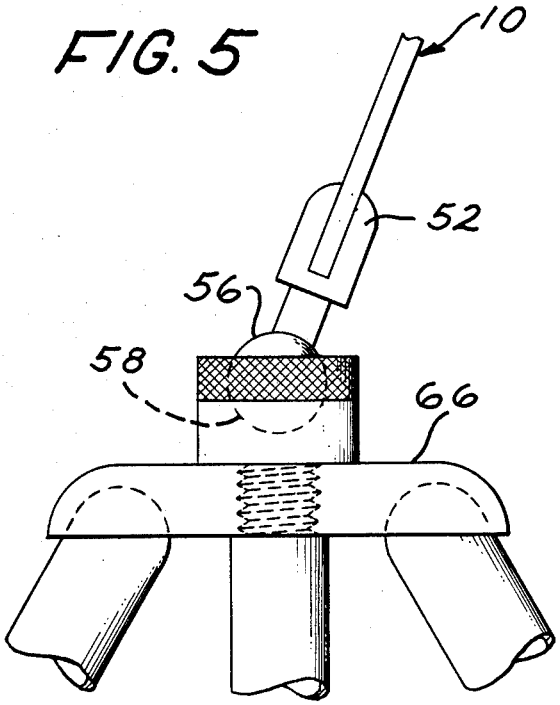
FIG. 5 is a fragmentary elevational view of the lower portion of the transparent tracing board showing a universal socket supported from the top portion of a tripod in place of the handle shown in FIG. 4.

FIG. 5 is a modification of the handle 12, where the ball 56 is supported in a socket 58 that is supported on top of a tripod 66, so that the user would have both hands free for making the tracing, especially if the tracing were complex and a long period of time is necessary in order to complete the tracing.

Having described above a novel invention of transparent perspective tracing board, it will readily be apparent that the handle 12 could be a simple flange added to one side edge of the drawing board for grasping with the user's thumb. Or the handle could be a cutout in the tracing board, similar to that used in hand-held easels.

Modifications of this invention will occur to those skilled in this art. Therefore, it is to be understood that this invention is not limited to the particular embodiments disclosed, but that it is intended to cover all modifications which are within the true spirit and scope of this invention as claimed.

What is claimed is:

1. A transparent perspective hand-held tracing board adapted for use with a sheet of transparent drawing material that is to be attached to the front surface thereof, said tracing board comprising:

a. a rigid panel of transparent material taken from the group consisting of plastic and glass:

b. a measured pattern imprinted on the transparent panel to assist in judging distance and relative angles:

c. a supporting handle secured adjacent one side edge and extending from the transparent panel, the handle providing mechanical advantage to assist in holding the panel steady for long periods of time, where the handle is for grasping by one hand in holding the panel in space at a predetermined angle and distance in front of a user, and an object at a distance may be sighted through the transparent panel and positioned within the measured pattern on the panel so that the said object can then be traced by the user's other hand with a drawing instrument that is capable of leaving a mark, wherein the said supporting handle is mounted on the lower edge of the transparent panel, and it includes a universal socket for providing angular adjustablity between the handle and the panel.

* * * * *